US011913668B2

(12) United States Patent
Kurihara et al.

(10) Patent No.: US 11,913,668 B2
(45) Date of Patent: Feb. 27, 2024

(54) AIR-CONDITIONING APPARATUS

(71) Applicant: Mitsubishi Electric Corporation, Tokyo (JP)

(72) Inventors: Makoto Kurihara, Tokyo (JP); Hiroyuki Yuze, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 842 days.

(21) Appl. No.: 16/971,136

(22) PCT Filed: Apr. 6, 2018

(86) PCT No.: PCT/JP2018/014764
§ 371 (c)(1),
(2) Date: Aug. 19, 2020

(87) PCT Pub. No.: WO2019/193755
PCT Pub. Date: Oct. 10, 2019

(65) Prior Publication Data
US 2021/0003316 A1 Jan. 7, 2021

(51) Int. Cl.
*F24F 13/20* (2006.01)
*F24F 1/0047* (2019.01)
(Continued)

(52) U.S. Cl.
CPC ..... *F24F 13/20* (2013.01); *F24F 1/0047* (2019.02); *F24F 1/0014* (2013.01);
(Continued)

(58) Field of Classification Search
CPC ..... F24F 13/20; F24F 13/02; F24F 13/0209; F24F 13/0236; F24F 13/0254;
(Continued)

(56) References Cited

U.S. PATENT DOCUMENTS

2016/0102871 A1* 4/2016 Yamasari ..... F24F 1/0325 165/122
2016/0102872 A1* 4/2016 Nakamoto ..... F24F 1/0063 165/122
(Continued)

FOREIGN PATENT DOCUMENTS

CN 113237168 A * 8/2021 ..... F24F 11/89
EP 0450543 A1 10/1991
(Continued)

OTHER PUBLICATIONS

International Search Report of the International Searching Authority dated Jun. 5, 2018 for the corresponding international application No. PCT/JP2018/014764 (and English translation).

*Primary Examiner* — Miguel A Diaz
(74) *Attorney, Agent, or Firm* — POSZ LAW GROUP, PLC

(57) ABSTRACT

An air-conditioning apparatus includes an air inlet through which air is suctioned; a fan configured to generate an air flow by suctioning the air from the air inlet; an electrical component box having a box body housing a control board configured to control an actuator provided in a main body, a lid that covers an opening of the box body, and a flange part positioned in a flow path of the air flow, the flange part being for fastening the lid to the box body; and a flow straightening part that covers the flange part.

3 Claims, 5 Drawing Sheets

(51) Int. Cl.
*F24F 1/0014* (2019.01)
*F24F 13/06* (2006.01)
*F24F 13/24* (2006.01)

(52) U.S. Cl.
CPC . *F24F 2013/0616* (2013.01); *F24F 2013/205* (2013.01); *F24F 2013/207* (2013.01); *F24F 2013/247* (2013.01)

(58) Field of Classification Search
CPC ..... F24F 13/06; F24F 13/08; F24F 13/081; F24F 13/082; F24F 13/084; F24F 2013/205
See application file for complete search history.

(56) References Cited

U.S. PATENT DOCUMENTS

| | | | | |
|---|---|---|---|---|
| 2017/0276396 | A1* | 9/2017 | Azumi | F24F 1/0047 |
| 2020/0124315 | A1* | 4/2020 | Qin | F24F 13/0209 |
| 2022/0018568 | A1* | 1/2022 | Gosciniak | F24F 13/20 |

FOREIGN PATENT DOCUMENTS

| | | | | | |
|---|---|---|---|---|---|
| EP | 2017544 | B1 * | 6/2013 | | F24F 1/0007 |
| EP | 3130864 | A1 * | 2/2017 | | F24F 1/00 |
| JP | H06-050312 | A | 2/1994 | | |
| JP | H08-317502 | A | 11/1996 | | |
| JP | 2000-009335 | A | 1/2000 | | |
| JP | 2016-080209 | A | 5/2016 | | |
| KR | 20070005176 | A * | 3/2011 | | |
| KR | 20110027508 | A * | 3/2011 | | |
| KR | 20190071391 | A * | 6/2017 | | |
| WO | WO-2007126072 | A1 * | 11/2007 | | F24F 1/0007 |

* cited by examiner

AIR-CONDITIONING APPARATUS

CROSS REFERENCE TO RELATED APPLICATION

This application is a U.S. national stage application of PCT/JP2018/014764 filed on Apr. 6, 2018, the contents of which are incorporated herein by reference.

TECHNICAL FIELD

The present disclosure relates to an air-conditioning apparatus having a fan for suctioning air.

BACKGROUND ART

By increasing the flow rate of air of an indoor unit, some air-conditioning apparatus makes it possible not only to increase the distance the air blown into a room can reach, but also to improve an energy saving performance during a rated capacity operation. However, increasing the flow rate of air causes an increase in the rotation frequency of the fan, and peak sound called "blade passing noise" may be generated from the fan and the vicinity of the fan. The peak sound is also called "NZ sound". The NZ sound is the peak sound having a frequency that is an integral multiple of the number of blades of the fan and the rotation frequency, and gives an unpleasant feeling to a user. Therefore, the NZ sound is a hindrance factor in increasing the flow rate of air at the indoor unit. There are a plurality of factors that cause the generation of the NZ sound. A pressure fluctuation due to turbulence in an air flow caused by turbulence in a flow of air suctioned by the fan is considered as one of the factors that cause the NZ sound.

In some indoor unit of an air-conditioning apparatus, an electrical component box housing a control board is disposed close to an air inlet to improve the workability at the time of installation and maintenance of the indoor unit. In such an indoor unit, the electrical component box often includes a box body housing a control board, and a lid covering an opening of the box body so that the control board is not exposed except when work is performed. The lid and the box body are provided with flanges for fastening the lid to the box body except when work is performed. When the fan suctions air from inside the room through the air inlet, the flanges generate turbulence in an air flow, which is a cause of the generation of the NZ sound.

There has been known some air-conditioning apparatus in which an electrical component box of an outdoor unit is provided with a protection cover for the purposes of preventing damage to a lead wire extending from an insertion hole of the electrical component box and preventing an ingress of water into the electrical component box through the insertion hole (see, for example, Patent Literature 1).

CITATION LIST

Patent Literature

Patent Literature 1: Japanese Unexamined Patent Application Publication No. 2000-9335

SUMMARY OF INVENTION

Technical Problem

The protection cover disclosed in Patent Literature 1 aims at preventing damage to the lead wire and an ingress of water, but a reduction of the NZ sound is not considered.

The present disclosure has been made to solve the above problem and to provide an air-conditioning apparatus capable of reducing the sound that the user feels unpleasant.

Solution to Problem

An air-conditioning apparatus according to an embodiment of the present disclosure includes an air inlet through which air is suctioned; a fan configured to generate an air flow by suctioning the air from the air inlet; an electrical component box having a box body housing a control board configured to control an actuator provided in a main body, a lid that covers an opening of the box body, and a flange part positioned in a flow path of the air flow, the flange part being for fastening the lid to the box body; and a flow straightening part that covers the flange part.

Advantageous Effects of Invention

According to an embodiment of the present disclosure, the generation of turbulence in the air flow at the flange part of the electrical component box is prevented, and the sound that the user feels unpleasant can be reduced.

DESCRIPTION OF EMBODIMENTS

Embodiment 1

Figure 1:
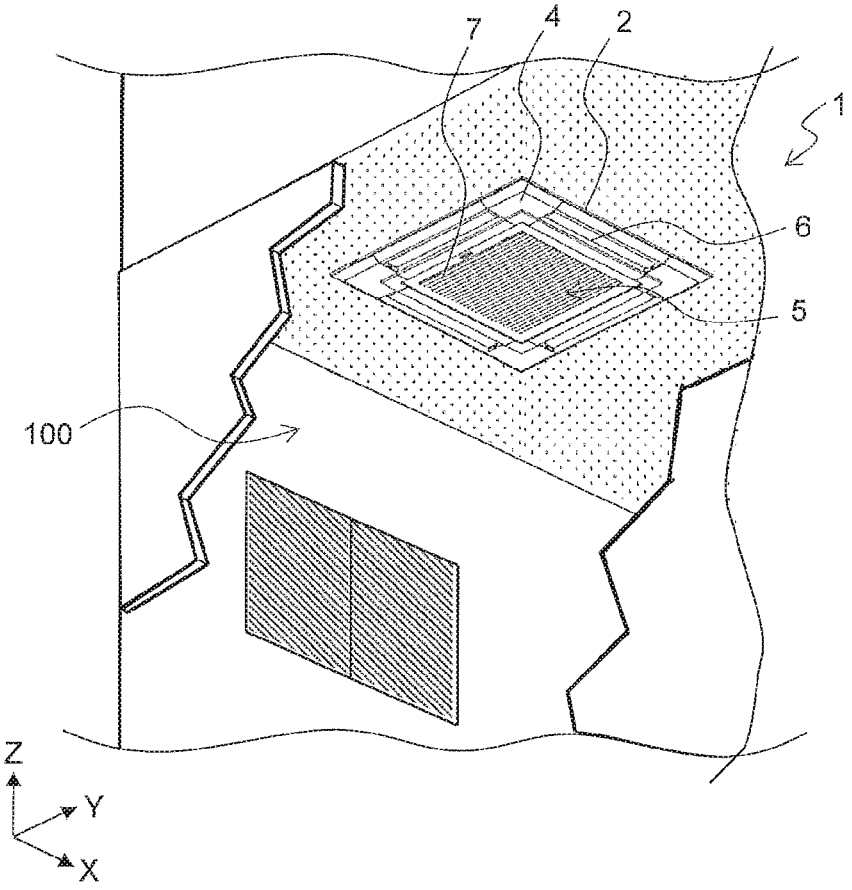
FIG. 1 is an external perspective view showing an example of the configuration of an indoor unit of an air-conditioning apparatus according to Embodiment 1 of the present disclosure.

A configuration of an indoor unit of an air-conditioning apparatus of Embodiment 1 will be described. FIG. 1 is an external perspective view showing an example of the configuration of the indoor unit of the air-conditioning apparatus according to Embodiment 1 of the present disclosure. In Embodiment 1, a ceiling embedded air-conditioning apparatus having an indoor unit embedded in the ceiling will be described. FIG. 1 shows an indoor state in which a part of a wall of a room 100 that is an air-conditioned space is removed for explanation purposes.

An air-conditioning apparatus 1 includes an indoor unit 2, and an outdoor unit, which is not shown. A bottom face (located low in the direction opposite to the Z-axis arrow) of the indoor unit 2 embedded in the ceiling of the room 100 is provided with a decorative panel 4, an air inlet 5 through which air is suctioned into an indoor unit main body from inside the room, and an air outlet 6 through which the air is blown from the indoor unit main body into the room. A filter 7 for preventing dust from being suctioned into the indoor unit main body from inside the room is attached to the air inlet 5.

Figure 2:
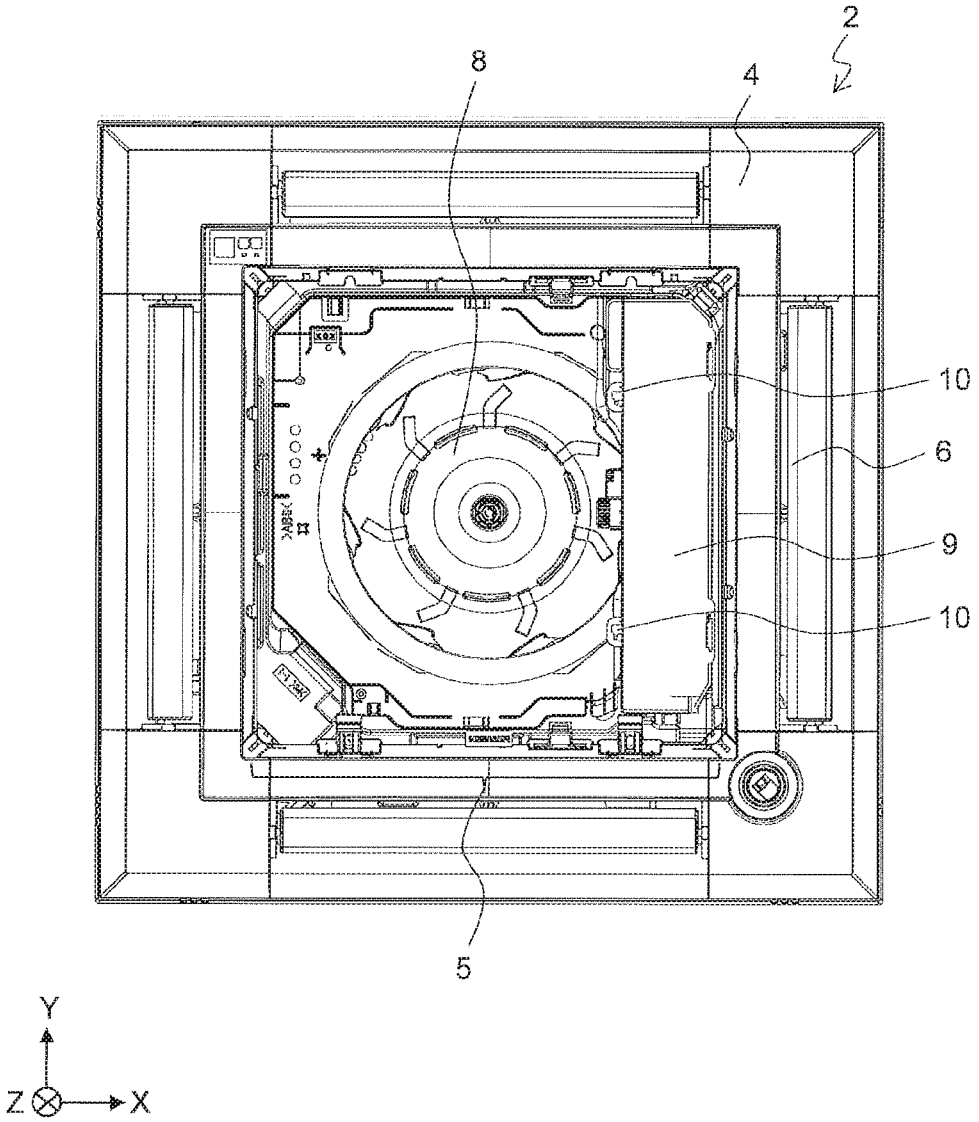
FIG. 2 is a bottom view showing some parts of the configuration of the indoor unit applied to the air-conditioning apparatus according to Embodiment 1 of the present disclosure.

A refrigerant circuit in which refrigerant circulates is formed by connecting the indoor unit 2 and the outdoor unit, which is not shown, through a refrigerant pipe. In Embodiment 1, the detailed description of the refrigerant circuit is omitted. Although not shown in FIG. 1, the indoor unit 2 is provided with an actuator such as an electronic expansion valve that is a component of the refrigerant circuit, FIG. 2 is a bottom view showing some parts of the configuration of the indoor unit applied to the air-conditioning apparatus according to Embodiment 1 of the present disclosure. FIG. 2 shows a state in which the filter 7 shown in FIG. 1 is removed from the decorative panel 4. As shown in FIG. 2, the indoor unit 2 has a fan 8 that suctions the air from the air inlet 5 and generates an air flow, and an electrical component box 9 including a control board configured to control the actuator provided in the indoor unit main body, and a terminal block for wiring. The electrical component box 9 is provided with flange parts 10. The flange parts 10 are positioned in a passage of the air flow generated by the fan 8.

Figure 3:
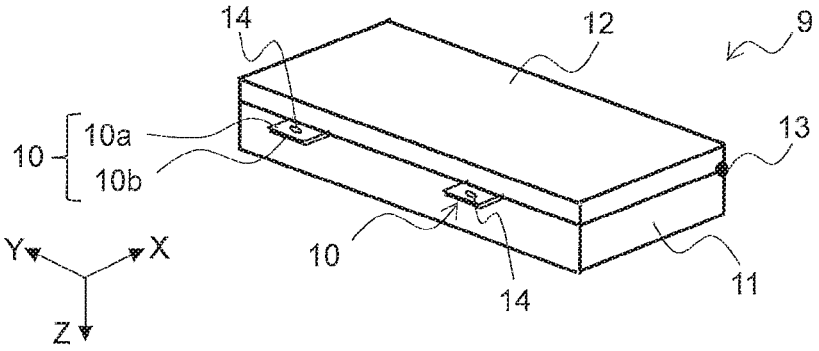
FIG. 3 is a schematic view showing the appearance of an example of the configuration of an electrical component box shown in FIG. 2.

A configuration of the electrical component box shown in FIG. 2 will be described. FIG. 3 is a schematic view showing the appearance of an example of the configuration of the electrical component box shown in FIG. 2. The electrical component box 9 includes a box body 11 housing the control board, a lid 12 that covers an opening of the box body 11, a hinge part 13 connecting the box body 11 and the lid 12, and the flange parts 10 for fastening the box body 11 and the lid 12 together. The flange parts 10 each include a flange 10*a* of the lid 12 and a flange 10*b* of the box body 11. Each of the flanges 10*a*, 10*b* is provided with a screw hole 14 for fastening the lid 12 to the box body 11 with a screw. FIG. 3 shows a state in which the lid 12 is closed, and thus the flanges 10*a* and the respective flanges 10*b* are overlapped each other. Although not shown in FIG. 3, when a worker opens the lid 12, the lid 12 rotates about the hinge part 13 as an axis, and the flanges 10*a* are separated from the flanges 10*b* with the rotation of the lid 12. Consequently, the control board and the terminal block housed in the box body 11 are exposed.

Figure 4:
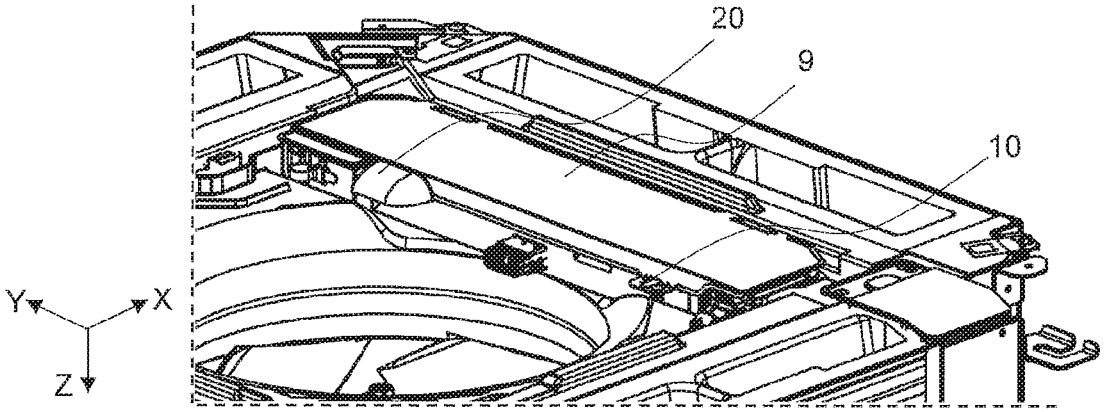
FIG. 4 is an external perspective view showing some parts of the indoor unit of the air-conditioning apparatus according to Embodiment 1 of the present disclosure.
Figure 5:
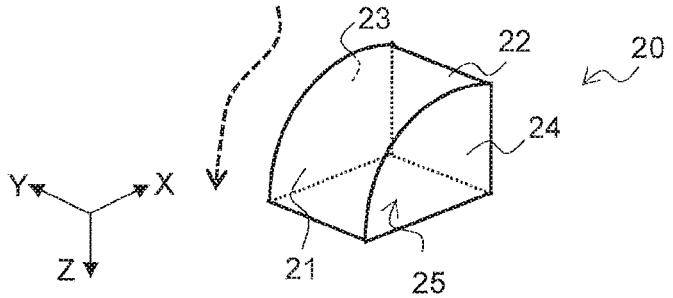
FIG. 5 is an external perspective view showing an example of the configuration of a flow straightening part shown in FIG. 4.

By screwing the screw into the screw holes 14 of each set of the flange 10*a* and the flange 10*b* in a state in which the lid 12 is closed, the lid 12 is fastened to the box body 11. The flange parts 10 are each for fastening the lid 12 and the box body 11 together when the air-conditioning apparatus 1 is in operation. FIGS. 2 and 3 show a case where the electrical component box 9 has two flange parts 10, but the number of the flange parts 10 is not limited to two. The number of the flange parts 10 may be one, or may be three or more. A device for fastening the flange 10*a* and the flange 10*b* is not limited to a screw, FIG. 4 is an external perspective view showing some parts of the indoor unit of the air-conditioning apparatus according to Embodiment 1 of the present disclosure. The indoor unit 2 of Embodiment 1 has flow straightening parts 20 that cover the respective flange parts 10. In FIG. 4, for explanation purposes, one of the flow straightening parts 20 covering one of the two flange parts 10 is shown and the other one of the flow straightening parts 20 to cover the other one of the flange parts 10 is not shown, FIG. 5 is an external perspective view showing an example of the configuration of the flow straightening part shown in FIG. 4. The flow straightening part 20 includes a flow straightening plate 21 that covers the flange part 10, a rectangular back plate 22, and side plates 23, 24 supporting the flow straightening plate 21 and the back plate 22. The flow straightening plate 21 has the shape of a curved surface over the flange part 10, which has a flat shape. An opening 25 is opened in the bottom of the flow straightening part 20.

The back plate 22 is attached to the electrical component box 9 in such a manner that the worker can attach and detach the flow straightening part 20 to and from the electrical component box 9. For example, a fastening device for attaching the back plate 22 to the lid 12 is a device such as a hook-and-loop fastener. In this case, the hook-and-loop fastener is provided on surfaces of the back plate 22 and the lid 12 that are brought into contact with each other. The fastening device may be a combination of a latch and a hook. By attaching the back plate 22 to the lid 12, the back plate 22 supports the flow straightening plate 21 at a side where the back plate 22 and the flow straightening plate 21 are in contact with each other, and the side plates 23, 24. The place where the flow straightening part 20 is attached is not limited to the electrical component box 9.

As shown in FIG. 4, the flow straightening plate 21 has a curved surface that covers the flange part 10 in a state in which the flow straightening part 20 is attached to the lid 12, and therefore the air flow generated by the fan 8 is smoothed along the flow straightening plate 21. In FIG. 5, the air flow is schematically shown by a broken line. The flow straightening plate 21 straightens the air flow from inside the room to the indoor unit main body through the air inlet 5, and prevents the generation of turbulence at the flange part 10. This will be described in detail.

As described with reference to FIG. 4, the flange part 10 is positioned in a flow path of an air flow that is generated when the fan 8 suctions the air from inside the room through the air inlet 5. At this time, the flange part 10 is a resistance to the air flow, and the NZ sound is generated when the air flow collides with the flange part 10. In contrast, in Embodiment 1, as shown in FIG. 4, as the flow straightening part 20 covers the flange part 10, the generation of turbulence in the air flow at the flange part 10 is prevented, thereby reducing the NZ sound.

In the case where the flow straightening plate 21 has a curved surface over the flange part 10, which has a flat shape, the air flow is smoothed along the flow straightening plate 21. As a result, the turbulence in the air flow is further reduced, and the NZ sound can be further reduced.

Figure 6:
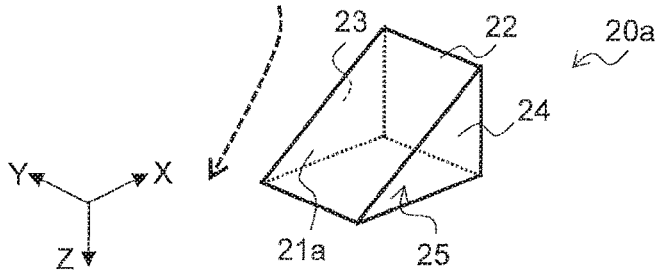
FIG. 6 is an external perspective view showing another example of the configuration of the flow straightening part shown in FIG. 4.

The configuration of the flow straightening part 20 shown in FIG. 4 is not limited to the configuration described with reference to FIG. 5. FIG. 6 is an external perspective view showing another example of the configuration of the flow straightening part shown in FIG. 4. A flow straightening plate 21*a* of a flow straightening part 20*a* shown in FIG. 6 has a slanting surface over the flange part 10, which has a flat shape. With the configuration shown in FIG. 6, the air flow is also smoothed along the flow straightening plate 21*a*. Thus, similarly to the flow straightening part 20, the flow straightening part 20*a* prevents the generation of turbulence at the flange part 10.

The air-conditioning apparatus 1 of Embodiment 1 includes the fan 8 configured to generate an air flow by suctioning the air from the air inlet 5, the electrical component box 9 having the flange parts 10 positioned in the flow path of the air flow, and the flow straightening parts 20 that cover the respective flange parts 10. The flange parts 10 are each for fastening the lid 12 to the box body 11. According to Embodiment 1, the generation of turbulence in the air flow at the flange parts 10 is prevented, and sound such as the NZ sound that the user feels unpleasant can be reduced.

In Embodiment 1, the flow straightening parts 20 are each attachable to and detachable from the lid 12, and the electrical component box 9 includes the box body 11 and the lid 12 that can be opened and closed. Hence, for example, for maintenance of the indoor unit 2, when the worker removes the filter 7 and the flow straightening parts 20 of the indoor unit 2 and opens the lid 12 by loosening the screws of the flange parts 10, work such as wiring connection can be performed. The attachment and detachment of the flow straightening parts 20 do not bother installation and maintenance work on the indoor unit 2.

Embodiment 2

In Embodiment 2, the flange parts 10 of the electrical component box 9 described in Embodiment 1 are fastened with screws. In Embodiment 2, the components described in Embodiment 1 are labeled with the same reference signs, and a detailed description of the components is omitted.

Figure 7:
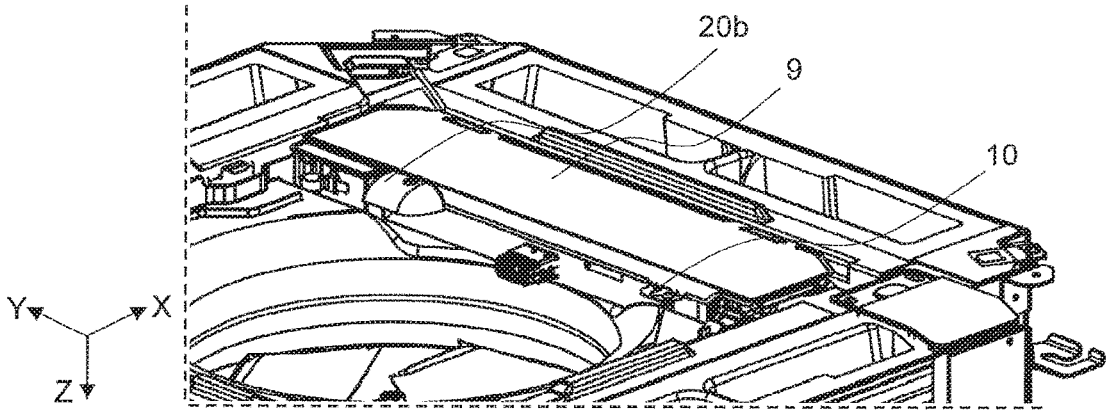
FIG. 7 is an external perspective view showing some parts of an indoor unit of an air-conditioning apparatus according to Embodiment 2 of the present disclosure.

A configuration of an air-conditioning apparatus of Embodiment 2 will be described. FIG. 7 is an external perspective view showing some parts of the indoor unit of the air-conditioning apparatus according to Embodiment 2 of the present disclosure, FIG. 8 is an external perspective view showing an example of the configuration of a flow straightening part shown in FIG. 7.

The indoor unit 2 of Embodiment 2 has flow straightening parts 20*b* that cover the respective flange parts 10. In FIG. 7, similarly to FIG. 4, one of the flow straightening parts 20*b* covering one of the two flange parts 10 is shown and the other one of the flow straightening parts 20*b* to cover the other one of the flange parts 10 is not shown. As shown in FIG. 8, the flow straightening part 20*b* has a flow straightening plate 21*b*, which has the shape of a curved surface. The flow straightening plate 21*b* is provided with a through-hole 26. Similarly to the flow straightening plate 21 described in Embodiment 1, the flow straightening plate 21*b* reduces turbulence in the air flow at the flange part 10.

Figure 8:
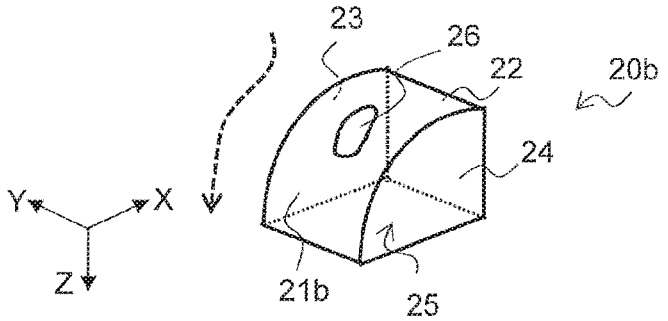
FIG. 8 is an external perspective view showing an example of the configuration of a flow straightening part shown in FIG. 7.
Figure 9:
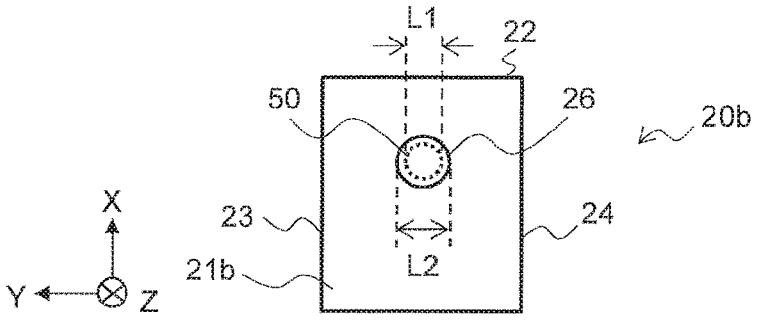
FIG. 9 is a diagram of the flow straightening part shown in FIG. 8 as seen in the direction of the Z-axis arrow.

FIG. 9 is a diagram of the flow straightening part shown in FIG. 8 as seen in the direction of the Z-axis arrow. FIG. 9 shows a case where the worker uses a screwdriver 50 to tighten the screw into the flange part 10 and to loosen the screw. The position of the screwdriver 50 on the XY plane coincides with the position of the through-hole 26, and thus the through-hole 26 is provided at the position facing the screw holes 14 of the flange part 10 shown in FIG. 3.

As shown in FIG. 9, a diameter L1 and a diameter L2 have the relationship L2>L1, where L1 is the diameter of the screwdriver 50, and L2 is the diameter of the through-hole 26. As the relationship of the diameter L2>the diameter L1 is established, the worker can insert the screwdriver 50 into the through-hole 26. On the other hand, the diameter L2 of the through-hole 26 is only required to be a diameter that allows the insertion of the screwdriver 50. The diameter L2 of the through-hole 26 is relatively small compared to a length of the flow straightening plate 21*b* in the direction of the Y-axis arrow, and therefore the influence on the generation of the NZ sound is small.

In the case where the flange parts 10 of the electrical component box 9 are fastened with screws, the worker needs to tighten or loosen the screws in the flange parts 10 at the time of installation and maintenance of the indoor unit 2. The flow straightening parts 20*b* of Embodiment 2 are fastened to the lid 12, and each have the through-hole 26 at the position facing the screw holes 14 of the corresponding one of the flange parts 10. Therefore, in a state in which the flow straightening parts 20*b* are fastened to the lid 12, the worker can insert the screwdriver 50 into the through-holes 26 and tighten or loosen the screws. Moreover, the worker does not need to detach or attach the flow straightening parts 20*b* when opening or closing the lid 12 of the electrical component box 9. Thus, the worker can open and close the lid 12 of the electrical component box 9 without detaching the flow straightening parts 20*b* from the indoor unit 2. The flow straightening parts 20*b* are not a factor of causing a decrease in the work efficiency at the time of installation and maintenance of the indoor unit 2. Even when the flange parts 10 of the electrical component box 9 are fastened with the screws, the work efficiency at the time of installation and maintenance of the indoor unit 2 is improved.

In Embodiment 2, the case where the through-hole 26 is provided in the flow straightening part 20 shown in FIG. 5 is described, but the through-hole 26 may be provided in the flow straightening part 20*a* shown in FIG. 6.

In the air-conditioning apparatus 1 of Embodiment 2, the back plate 22 of each of the flow straightening parts 20*b* is fastened to the lid 12, and the flow straightening plates 21*b* are each provided with the through-hole 26 at the position facing the screw holes 14 of the corresponding one of the flange parts 10. In Embodiment 2, the same effect as in Embodiment 1 is obtained. Furthermore, in the state in which the flow straightening parts 20*b* are attached to the lid 12, the worker can insert the screwdriver 50 into the through-holes 26 and tighten or loosen the screws, and can also open and close the lid 12 of the electrical component box 9. As a result, even when the flange parts 10 of the electrical component box 9 are fastened with the screws, the work efficiency at the time of installation and maintenance of the indoor unit 2 is improved.

Embodiment 3

In Embodiment 3, in the flow straightening part 20*b* described in Embodiment 2, the visibility of the screw for fastening the flange part 10 is improved. In Embodiment 3, the components described in Embodiments 1 and 2 are labeled with the same reference signs, and a detailed description of the components is omitted.

Figure 10:
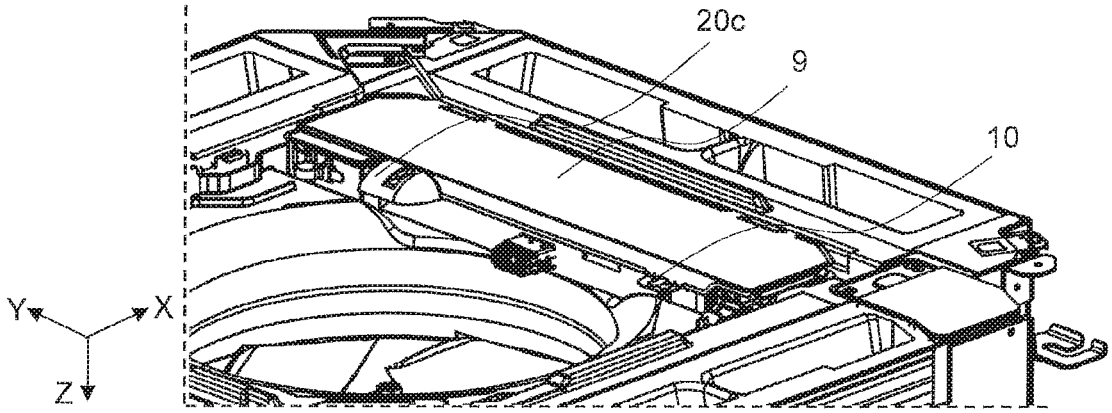
FIG. 10 is an external perspective view showing some parts of an indoor unit of an air-conditioning apparatus according to Embodiment 3 of the present disclosure.
Figure 11:
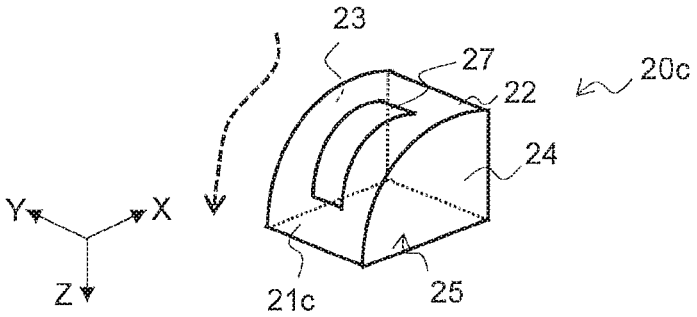
FIG. 11 is an external perspective view showing an example of the configuration of a flow straightening part shown in FIG. 10.

A configuration of an air-conditioning apparatus of Embodiment 3 will be described. FIG. 10 is an external perspective view showing some parts of the indoor unit of the air-conditioning apparatus according to Embodiment 3 of the present disclosure. FIG. 11 is an external perspective view showing an example of the configuration of the flow straightening part shown in FIG. 10.

The indoor unit 2 of Embodiment 3 has flow straightening parts 20*c* that cover the respective flange parts 10. In FIG. 10, similarly to FIG. 4, one of the flow straightening parts

20*c* covering one of the two flange parts 10 is shown and the other one of the flow straightening parts 20*c* to cover the other one of the flange parts 10 is not shown. As shown in FIG. 11, the flow straightening part 20*c* has a flow straightening plate 21*c*, which has the shape of a curved surface. The flow straightening plate 21*c* is provided with a through-hole 27 in a rectangular shape with a longitudinal direction parallel to the direction of the X-axis arrow. Similarly to the flow straightening plate 21 described in Embodiment 1, the flow straightening plate 21*c* reduces turbulence in the air flow at the flange part 10.

Figure 12:
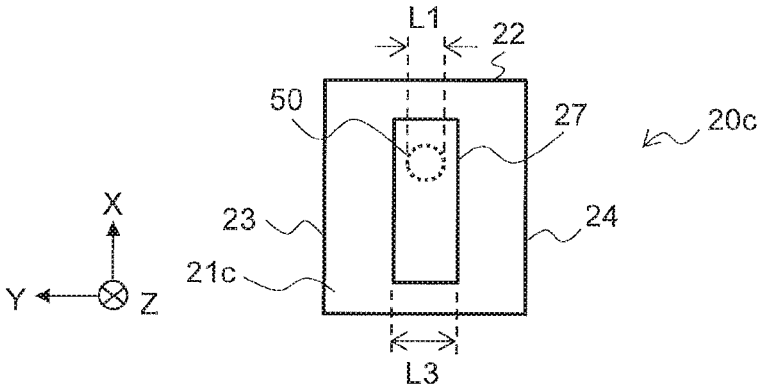
FIG. 12 is a diagram of the flow straightening part shown in FIG. 11 as seen in the direction of the Z-axis arrow.

FIG. 12 is a diagram of the flow straightening part shown in FIG. 11 as seen in the direction of the Z-axis arrow. FIG. 12 shows a case where the worker uses the screwdriver 50 to tighten the screw into the flange part 10 and to loosen the screw. The position of the screwdriver 50 on the XY plane is included in the area of the through-hole 27, and thus the through-hole 27 is a rectangular opening including the position facing the screw holes 14 of the flange part 10 shown in FIG. 3.

As shown in FIG. 12, a width L3 and the diameter L1 have the relationship L3>L1, where L3 is the width of the through-hole 27 (the length in the direction of the Y-axis arrow), and L1 is the diameter of the screwdriver 50. As the relationship of the width L3>the diameter L1 is established, the worker can insert the screwdriver 50 into the through-hole 27. On the other hand, the width L3 of the through-hole 27 is only required to be a length that allows the insertion of the screwdriver 50. The width L3 of the through-hole 27 is relatively small compared to the length of the flow straightening plate 21*c* in the direction of the Y-axis arrow, and therefore the influence on the generation of the NZ sound is small.

In Embodiment 3, the flow straightening plates 21*c* are each provided with the through-hole 27 by cutting out an area including the through-hole 26 shown in FIG. 8. Hence, the same effect as in Embodiment 2 is obtained. Further, the through-hole 27 is a rectangular opening elongated from the position facing the screw holes 14 of the flange part 10 to a direction opposite to the X-axis arrow of FIG. 12. Therefore, the worker can easily see the screws for fastening the flange parts 10, and the visibility of the screws and the work efficiency are improved.

In Embodiment 3, the case where the through-hole 27 is provided in the flow straightening part 20 shown in FIG. 5 is described, but the through-hole 27 may be provided in the flow straightening part 20*a* shown in FIG. 6.

In the air-conditioning apparatus 1 of Embodiment 3, the flow straightening plate 21*c* of each of the flow straightening parts 20*c* is provided with the rectangular through-hole 27 including the position facing the screw holes 14 of the corresponding one of the flange parts 10. In Embodiment 3, not only the same effects as in Embodiment 1 and Embodiment 2 are obtained, but also the visibility of the screws for fastening the flange parts 10 is improved for the worker, and the work efficiency is further improved.

In Embodiments 1 to 3, although the cases where the flow straightening parts 20, 20*a* to 20*c* are applied to the indoor unit 2 of the air-conditioning apparatus 1 are described, the flow straightening parts 20, 20*a* to 20*c* may be applied not only to the indoor unit 2 but also to the outdoor unit. Further, although the air-conditioning apparatus 1 including the indoor unit 2 and the outdoor unit is described, the indoor unit 2 may be an apparatus that performs heating or cooling by itself. Furthermore, an obstacle that causes turbulence is not limited to the flange part 10 of the electrical component box 9. Embodiments 1 to 3 can be applied to any apparatus that has, in the flow path, an obstacle that disturbs an air flow generated by a fan.

REFERENCE SIGNS LIST

1 air-conditioning apparatus 2 indoor unit 4 decorative panel 5 air inlet 6 air outlet 7 filter 8 fan 9 electrical component box 10 flange part 10*a*, 10*b* flange 11 box body 12 lid 13 hinge part 14 screw hole 20, 20*a* to 20*c* flow straightening part 21, 21*a* to 21*c* flow straightening plate 22 back plate 23, 24 side plate 25 opening 26, 27 through-hole 50 screwdriver 100 room

The invention claimed is:

1. An air-conditioning apparatus, comprising:

an air inlet through which air is suctioned;

a fan configured to generate an air flow by suctioning the air from the air inlet;

an electrical component box having a box body, a lid that covers an opening of the box body, and a flange part positioned in a flow path of the air flow, the flange part being for fastening the lid to the box body; and a flow straightening part that covers the flange part, the flow straightening part including a flow straightening plate having a curved surface or a slanting surface over the flange part to cover the flange part, and a back plate that supports the flow straightening plate and is fastened to the lid, the flow straightening plate having a through-hole at a position facing a screw hole of the flange part in a direction parallel to an axis of the screw hole of the flange part.

2. The air-conditioning apparatus of claim 1, wherein the through-hole is a rectangular opening including the position facing the screw hole of the flange part in the direction parallel to the axis of the screw hole of the flange part.

3. The air-conditioning apparatus of claim 1, wherein the flow straightening part further includes two side plates, and each of the side plates is in contact with the flow straightening plate and the back plate.

* * * * *